United States Patent [19]

Merritt

[11] Patent Number: 4,674,456

[45] Date of Patent: Jun. 23, 1987

[54] OIL-CHANGING SYSTEM FOR AN INTERNAL COMBUSTION ENGINE

[76] Inventor: Timothy K. Merritt, 117 Arbor Park North, Louisville, Ky. 40214

[21] Appl. No.: 768,358

[22] Filed: Dec. 13, 1985

[51] Int. Cl.[4] ..... F01M 1/00

[52] U.S. Cl. ..... 123/196 S; 123/196 R; 184/1.5

[58] Field of Search ..... 123/196 S, 196 R; 184/1.5, 105.1

[56] References Cited

U.S. PATENT DOCUMENTS

| | | | |
|---|---|---|---|
| 2,796,148 | 6/1957 | Banks | 184/1.5 |
| 3,282,380 | 11/1966 | Burrell et al. | 184/1.5 |
| 3,447,636 | 6/1965 | Bofilio | 123/196 S |
| 3,720,287 | 3/1973 | Martel | 184/1.5 |
| 3,867,999 | 2/1975 | Cox | 184/1.5 |
| 3,929,645 | 12/1975 | Bugelski | 184/1.5 |
| 4,095,571 | 6/1978 | Fleetwood et al. | 123/575 |
| 4,151,823 | 5/1979 | Grosse et al. | 123/196 A |
| 4,417,561 | 11/1983 | Yasuhara | 123/196 S |
| 4,421,078 | 12/1983 | Hurner | 123/196 S |

FOREIGN PATENT DOCUMENTS

| | | | |
|---|---|---|---|
| 56-507 | 1/1981 | Japan | 184/1.5 |

*Primary Examiner*—E. Rollins Cross

*Attorney, Agent, or Firm*—Norman B. Rainer

[57] ABSTRACT

A method and apparatus are provided for effecting the periodic partial replacement of used lubricating oil with fresh lubricating oil in the oil-confining reservoir of an internal combustion engine. The apparatus utilizes a first container which holds fresh oil, a second container which holds used oil, and associated pumps which transfer fresh oil to the engine and remove used oil therefrom. Monitoring means record the extent of usage of the oil and dictate the operation of the pumps.

8 Claims, 1 Drawing Figure

OIL-CHANGING SYSTEM FOR AN INTERNAL COMBUSTION ENGINE

BACKGROUND OF THE INVENTION

This invention concerns a lubricating oil system for an engine, and more particularly relates to a system for maintaining proper oil quality in an internal combustion engine.

In conventional piston driven four-cycle internal combustion engines powered by gasoline, particularly those engines utilized in automotive vehicles, a crankcase is provided as a reservoir for a lubricating oil which is distributed to moving components susceptible to frictional wear. In the course of extended use, however, the oil loses its initial qualities due to :(a) accumulation of combustion-generated solid debris and acidic chemical species, (b) accumulation of frictionally generated metallic particles, and (c) thermally induced degradation of molecular weight with attendant drop in viscosity. Such deterioration in the quality of the lubricating oil is generally remedied by periodically draining all the oil from the crankcase after a prescribed length of usage and replacing it with fresh oil.

Such periodically complete oil changes, however, are sometimes not carried out when required due to neglect or oversight, thereby resulting in damage to the engine.

In the case of diesel engines, systems have been disclosed for gradually and continuously removing old oil by feeding it into the fuel, and replenishing fresh oil to the oil reservoir. Although such expendient may be successful in a diesel engine, it cannot be done with a gasoline engine. Furthermore, such method of discarding old oil produces a significantly dirtier exhaust gas of air-polluting consequences. In those systems disclosed for automatically removing oil from a crankcase, or adding oil to a crankcase, very specialized and expensive components are utilized which can only be incorporated into the engine by the manufacturer.

It is accordingly an object of the present invention to provide a system for partially exchanging old oil for fresh oil in a crankcase at pēriodic intervals.

It is another object of this invention to provide a system as in the foregoing object wherein the rate at which the oil is partially exchanged is substantially equal to the prescribed rate for a complete oil change.

It is a further object of the present invention to accomplish the aforesaid partial exchange of oil utilizing means for recording the extent of use of said oil and dictating automatic or manual activation of oil changing means.

It is yet another object of this invention to provide apparatus for achieving the aforesaid oil changing which can be installed into an existing internal combustion engine.

These objects and other objects and advantages of the invention will be apparent from the following description.

SUMMARY OF THE INVENTION

The above and other beneficial objects and advantages are accomplished in accordance with the present invention by a method for maintaining the quality of lubricating oil in an internal combustion engine comprising the removal of used oil from the oil reservoir thereof, and the simultaneous addition of a substantially equal volume of fresh oil to the reservoir, the rate of said removals and additions being substantially equal to the engine manufacturer's recommended rate of complete oil change based upon engine usage factors.

The present invention further encompasses oil-changing apparatus adapted for use in operative association with the oil reservoir of an internal combustion engine comprising:

(a) first container adapted to confine fresh lubricating oil, (b) a second container adapted to confine used lubricating oil, (c) a first electrically operated pump adapted to transfer oil from said first container to said reservoir, (d) a second electrically operated pump adapted to transfer oil from said reservoir to said reservoir to said second container, (e) conduit means communicating between said reservoir, pumps and containers, and (f) monitoring means for recording the extent of usage of the oil and dictating the operation of said pumps.

In preferred embodiments of the invention, the system is utilized in an automotive engine of the type employed in automobiles and other self-propelled vehicles. A particularly preferred engine is a gasoline-burning four-cycle internal combustion engine wherein the oil reservoir is primarily a crankcase. The monitoring means may record the extent of oil usage by recording running time of the engine or miles driven, and may be adapted to either automatically activate the pumps or remind the operator of the vehicle of the need to manually activate the pumps.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts.

DESCRIPTION OF THE PREFERRED EMBODIMENT

Figure 1:
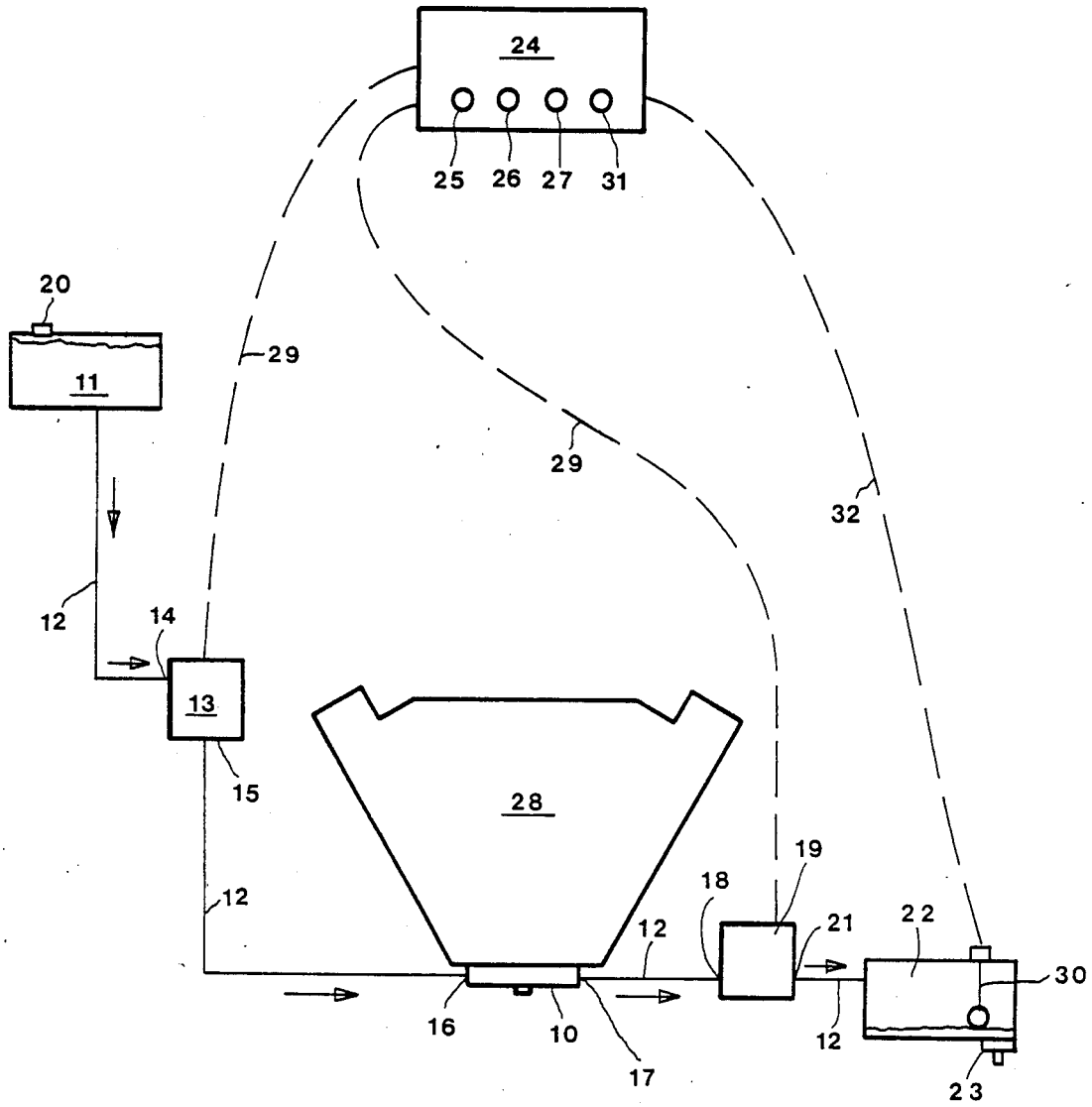
FIG. 1 is a schematic illustration of an embodiment of the oil-changing apparatus of this invention, shown in association with an engine crankcase of conventional design.

Referring to the drawing, an embodiment of the oil-changing apparatus of the present invention is shown in association with an engine 28 having a conventional crankcase oil reservoir 10, said apparatus being comprised of first container 11 having entrance port 20, and communicating by means of rigid conduit tubing 12 with the intake 14 of first electrically operated pump 13. Said first pump may be a centrifugal or positive displacement pump capable of generating a significant output pressure while preventing backflow during active and inactive periods. Check-valve means of conventional design (not shown) may be associated with the output 15 of said first pump which is connected by tubing 12 to a first extremity 16 of crankcase 10. The opposite extremity 17 of said crankcase communicates by means of said tubing with the intake 18 of second electrically operated pump 19 designed similarly to said first pump. The outlet port 21 of said second pump communicates by tubing 12 with second container 22 having exit drain 23. In preferred embodiments, fluid level detector means 30 may be incorporated into either container.

A control panel 24, adapted to be positioned adjacent the operating controls of the vehicle, is provided with electrical leads 29 that permit activation of the first and second pumps. The control panel may be further provided with an electrical on-off switch 25, a pilot light 26 which indicates when the pumps are running, a reminder light 27 which indicates to the vehicle operator the nedd to activate the pumps, and an oil level indicator 31 which communicates by lead wire 32 with level detector 30. In alternative embodiments, the control panel may be provided with means for recording the engine running time or the miles driven, and such means may receive a modifying input signal from a thermocouple which measures engine temperature. For example, if the thermocouple detects above-average engine operating temperatures, it may cause the rate of oil replacement to be increased. The thermocouple is also useful in preventing oil replacement when the engine is not at proper operating temperature. The control panel may be further adapted to automatically activate the pumps when a prescribed amount of engine use is measured by the aforesaid recording means.

In operation, a quantity of fresh lubricating oil roughly equal in volume to the total oil-holding capacity of the oil reservoir is poured into said first container. Recording means on the control panel are adjusted so that the rate of oil changeover can be monitored. For example, if the manufacturer's recommendation is that the five quarts of oil in an engine be replaced every 3,000 miles, the system of this invention is programmed to remove one quart of used oil every 600 miles, while adding fresh oil at a substantially equal rate to maintain a constant amount of oil within the oil reservoir of the engine. In preferred embodiments, not more than 20% of the total oil content of the reservoir will be changed at any given time.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A method for maintaining the quality of lubricating oil in an internal combustion engine having an oil reservoir comprising periodically removing used oil from said reservoir in an amount no greater than 20% of the total capacity of the reservoir, and simultaneously adding to said reservoir a substantially equal volume of fresh oil, the rate of said removals and additions being substantially equal to the engine manufacturer's recommended rate of complete oil change based upon engine usage factors, said removing and adding of oil being effected at opposite extremities of said reservoir and accomplished by electrically operated pumps capable of generating a significant output pressure while preventing backflow, the operation of said pumps being dictated by monitoring means which record the extent of oil usage, and said removed used oil being transferred to a container having an exit drain.

2. Oil-changing apparatus for use in operative association with the oil reservoir of an internal combustion engine comprising:

(a) a first container adapted to confine fresh lubricating oil, (b) a second container adapted to confine used luricating oil, (c) a first electrically operated pump adapted to transfer oil from said first container to said reservoir, (d) a second electrically operated pump adapted to transfer oil from said reservoir to said second container, (e) conduit means communicating between said reservoir, pumps and containers, and (f) monitoring means for recording the extent of usage of the oil and dictating the operation of said pumps.

3. The oil-changing apparatus of claim 2 wherein said engine is a gasoline-burning four-cycle engine as used in automotive vehicles.

4. The oil-changing apparatus of claim 2 wherein said oil reservoir is a crankcase.

5. The oil-changing apparatus of claim 2 wherein said monitoring means records the running time of the engine.

6. The oil-changing apparatus of claim 3 wherein said monitoring means records the miles drive.

7. The oil-changing apparatus of claim 2 wherein said monitoring means automatically activates said pumps.

8. The oil-changing apparatus of claim 3 wherein said monitoring means reminds the operator of the vehicle of the need to manually activate said pumps.

* * * * *